United States Patent [19]

Osberghaus

[11] Patent Number: 4,725,319

[45] Date of Patent: Feb. 16, 1988

[54] CLEANING PREPARATIONS FOR HARD SURFACES

[75] Inventor: Rainer Osberghaus, Duesseldorf, Fed. Rep. of Germany

[73] Assignee: Henkel Kommanditgesellschaft auf Aktien, Duesseldorf, Fed. Rep. of Germany

[21] Appl. No.: 905,713

[22] Filed: Sep. 9, 1986

[30] Foreign Application Priority Data

Sep. 20, 1985 [DE] Fed. Rep. of Germany ..... 3533531

[51] Int. Cl.[4] ..... B08B 7/00; C11D 17/00

[52] U.S. Cl. ..... 134/4; 134/40; 252/DIG. 2; 252/DIG. 14; 252/174.23; 252/174.24; 252/153; 252/90

[58] Field of Search ..... 134/4, 40; 252/DIG. 2, 252/DIG. 14, 174.23, 174.24, 153, 90

[56] References Cited

U.S. PATENT DOCUMENTS

| | | | |
|---|---|---|---|
| 3,716,488 | 2/1973 | Kolsky et al. | 252/155 |
| 3,723,323 | 3/1973 | Morgan et al. | 252/90 |
| 3,723,358 | 3/1973 | Morgan et al. | 252/90 X |
| 3,835,071 | 9/1974 | Allen et al. | 252/545 |
| 3,901,727 | 8/1975 | Londas | 134/4 |
| 3,976,501 | 8/1976 | Blue | 134/40 X |
| 3,994,744 | 11/1976 | Anderle et al. | 134/4 |
| 4,002,571 | 1/1977 | Anderle et al. | 252/90 |
| 4,230,605 | 10/1980 | Connolly et al. | 252/153 X |
| 4,537,802 | 8/1985 | Flanagan | 252/153 X |
| 4,565,644 | 1/1986 | Smith et al. | 252/153 X |
| 4,609,406 | 9/1986 | Mogyar et al. | 134/4 X |
| 4,612,058 | 9/1986 | Geke et al. | 252/174.23 X |

FOREIGN PATENT DOCUMENTS

| | | | |
|---|---|---|---|
| 1430204 | 3/1976 | United Kingdom | 252/174.24 |

*Primary Examiner*—Helen M. S. Sneed
*Assistant Examiner*—William G. Wright
*Attorney, Agent, or Firm*—Ernest G. Szoke; Henry E. Millson, Jr.; Real J. Grandmaison

[57] ABSTRACT

A composition consisting essentially of surfactants, non-metal-crosslinked polymers, alkaline-reacting complexing agents, and a water-soluble organic solvent is suitable for preserving and cleaning hard surfaces, particularly floors. It is used in highly dilute form and leaves behind a hard, but readily redissolvable transparent protective film.

10 Claims, No Drawings

CLEANING PREPARATIONS FOR HARD SURFACES

BACKGROUND OF THE INVENTION

1. Field of the Invention

The present invention relates to the cleaning and care of hard surfaces, particularly floors, in the home and in institutional cleaning using aqueous cleaning preparations.

In the cleaning and preservation of hard surfaces, the choice of the particular cleaning process and of the preparations to be used is determined not only by hygienic and aesthetic aspects, but also and above all by economic considerations and by the nature of the surface. Since varying significance is attributed to each of these criteria in individual cases, it is not surprising that various different processes and preparations have already been developed for these tasks. The choice of the particular preparation is essentially determined by whether the priority is to clean or to preserve the surface.

2. Discussion of the Related Art

Thus, preparations which produce more or less hard resistant films are primarily used for the care and preservation of surfaces. To this end, the preparations contain, mostly in emulsified form, waxes or film-forming polymers and crosslinking agents, generally heavy metal salts, which together form self-shine or polishable films on the treated surfaces after drying. Long-lasting preservation of the surfaces may be obtained in this way, the film withstanding even severe mechanical stress, depending on its quality. The disadvantage of these preparations is that removal of the firmly adhering films when necessary, for example through soiling or damage, is only possible under extreme conditions.

By contrast, preparations designed primarily for cleaning contain high proportions of surfactants, often together with alkaline-reacting substances, organic solvents or abrasives. In many cases, thorough removal of soil and old coating is possible with these preparations, although the surfaces thus cleaned are then generally exposed without protection to resoiling unless a preserving treatment is applied.

Since in many cases it is desired both to clean and to preserve surfaces, there has been no shortage of attempts, with a view to simplifying the work involved, to develop preparations with which cleaning and preservation may be achieved in one step. Unfortunately, none of the hitherto proposed solutions has proved satisfactory.

Thus, preparations containing the usual film formers in very low concentrations often lead to a troublesome accumulation of films which, after certain periods, necessitates additional cleaning. Other preparations require special expensive polymers or form overly soft films which afford only minimal protection against resoiling. Soap-based preparations, which are also in this catagory, also give extremely soft films and, in addition, are sensitive to water hardness.

Accordingly, the problem still exists of developing preparations having an improved property for the simultaneous cleaning and preservation of hard surfaces, particularly floors.

3. Description of the Invention

Other than in the operating examples, or where otherwise indicated, all numbers expressing quantities of ingredients or reaction conditions used herein are to be understood as modified in all instances by the term "about."

The present invention offers a solution to this problem in the form of a floor cleaning composition consisting essentially of:

(a) from 0.5 to 10% by weight of a surfactant selected from the group consisting of the adducts of ethylene oxide with alcohols or alkylphenols, alkylbenzene sulfonates, alkylsulfonates, alkane sulfonates, fatty acid ester sulfonates and mixtures thereof;

(b) from 0.1 to 4.5% by weight of an alkali-soluble, non-metal-crosslinked polymer compound having a minimum film-forming temperature of from 0 to 70° C.;

(c) from 0.01 to 5% by weight of an alkaline-reacting complexing agent;

(d) from 0 to 3% by weight of an alkalizing agent;

(e) from 0 to 40% by weight of a water-miscible organic solvent;

(f) from 0 to 5% by weight of additives; and (g) the remainder, water.

This composition is applied by initially preparing a preferably 1 to 3% solution of the composition by dilution with water, applying the solution thus prepared to the surfaces to be cleaned using a wiping cloth, sponge or similar aid, and then partly removing it with the soil from the surface. After this treatment, the surface is not rinsed down so that the remaining solution of cleaning preparation is able to dry to form a uniformly protective film. Because of this method of application, compositions of the type in question are also known as wiping preparations. Despite its simple composition, the preparation according to the invention is distinguished by its optimal cleaning action with respect to a number of different soils and at the same time forms a resistant film which affords excellent protection against resoiling. In contrast to other preparations, this film is completely transparent and allows the color and texture of the treated surfaces to appear unchanged without any additional shine occurring. When the preparation is reapplied, the film dissolves and thus facilitates the cleaning process, thus no troublesome accumulation of film occurs.

The preparation according to this invention is particularly suitable for the preservation and cleaning of floors, providing excellent results on stone, sealed parquet, tiles, linoleum and plastics flooring. The preparation of this invention is applied with particular advantage to high-gloss floor coverings because the film formed, by virtue of its high transparency, does not reduce the gloss. A preparation having the following composition is preferably used: (a) from 1 to 6% by weight of a surfactant selected form the group consisting of adducts of ethylene oxide with alcohols or alkylphenols, alkylbenzene sulfonates, alkylsulfates, alkane sulfonates, fatty acid ester sulfonates and mixtures thereof, (b) from 0.2 to 2.9% by weight of an alkali-soluble, non-metal-crosslinked polymer compound having a minimum film-forming temperature of from 0° to 70° C. (c) from 0.05 to 3% by weight of an alkaline-reacting complexing agent; (d) from 0.05 to 2% by weight of an alkalizing agent; (e) from 0 to 20% by weight of a water-miscible organic solvent; (f) from 0.05 to 2% by weight of additives; and (g) the remember, water.

The individual constituents of the preparation, which bring about its properties by their coordination, may be more exactly defined as follows:

SURFACTANTS

Water-soluble surfactants unaffected by hardness selected from the group consisting of adducts of ethylene oxide with alcohols or alkylphenols, alkylbenzene sulfonates, alkyl sulfates, alkane sulfonates, fatty acid ester sulfonates and mixtures thereof are generally suitable for the preparations according to the invention. The quantities present are from 0.5 to 10% by weight, and preferably from 1 to 6% by weight, based on the undiluted preparation. Nonionic and anionic surfactants are preferably used together.

The nonionic surfactants mentioned above are adducts of from 4 to 40 and preferably from 8 to 20 moles of ethylene oxide (EO) with 1 mole of an aliphatic $C_{10}$–$C_{20}$ alcohol or alkylphenol. The aliphatic alcohols may be branched or unsaturated and may contain primary and/or secondary hydroxyl groups. Adducts of ethylene oxide with unbranched primary and secondary alcohols, particularly fatty alcohols and oxoalcohols, are preferred.

Typical representatives of suitable nonionic surfactants are nonylphenol containing 13 moles of ethylene oxide, internal $C_{15}$–$C_{17}$-alkane diol containing 9 moles of ethylene oxide, $C_{14}$–$C_{15}$-oxoalcohol containing 11 moles of ethylene oxide, cocosalcohol containing 7 moles of ethylene oxide, and tallow alcohol containing 14 moles of ethylene oxide.

Adducts of from 8 to 20 moles ethylene oxide with $C_{12}$–$C_{18}$ fatty alcohols are preferably used as the nonionic surfactants.

The above-mentioned anionic surfactants emanate from the sulfonate and sulfate classes and are always used as salts, preferably as sodium salts. The sulfonate surfactants are alkylbenzene sulfonates containing $C_9$–$C_{15}$ alkyl groups, esters of $\alpha$-sulfo fatty acids, for example, the $\alpha$-sulfonated methyl or ethyl ester of hydrogenated coconut oil, palm kernal oil or tallow fatty acids, and also the alkane sulfonates obtainable from $C_{12}$–$C_{18}$ alkanes by sulfonchlorination or sulfoxidation and subsequent hydrolysis or neutralization or by addition of bisulfites onto olefins. Suitable surfactants of the sulfate type or the sulfuric acid monoesters of primary alcohols of natural and synthetic origin, i.e. fatty alcohols, such as for example coconut oil fatty alcohols, tallow fatty alcohols, oleyl alcohol, or the $C_{10}$–$C_{20}$ oxoalcohols, and those of secondary alcohols having the same chain length. Alkylbenzene sulfonates and alkane sulfonates are preferably used as the anionic surfactants.

Good to very good cleaning results are obtained with all the nonionic and anionic surfactants mentioned above although it is possible in many cases, without any loss of cleaning performance, to replace a relatively small proportion, i.e. up to about 50%, of these surfactants by other types, such as, for example, ethylene oxide adducts with polypropylene oxide or with fatty acid amides or olefin sulfonates, sulfosuccinates and alkyl ether sulfates.

ALKALI-SOLUBLE POLYMERS

In general, any polymer compounds soluble in water in the alkaline range, providing they are not metalcrosslinked and have a minimum film-forming temperature of from 0° to 70° C., are suitable. The polymer compounds herein are generally copolymers of at least three different monomers. Their solubility is at least 0.1% and preferably 0.2% at a pH-value of from 8 to 10.5 and more especially in the range of from 8.5 to 9.5.

The polymers preferably used contain as their most important constituent an acrylate copolymer of from 1 to 30 parts by weight, based on copolymer, of monomers containing carboxylic acid groups, from 30 to 70 parts by weight of monomers which form homopolymers having glass transition temperatures below 20° C. preferably esters of acrylic acid with $C_1$–$C_8$ alcohols and/or of methacrylic acid with $C_4$–C8 alcohols and from 30 to 70 parts by weight of comonomers which form homopolymers having glass transition temperatures above room temperature, preferably methacrylic acid esters of $C_1$–C3 alcohols or styrene.

Ethylenically unsaturated carboxylic acids may be used as the comonomers containing acid groups; acrylic acid and methacrylic acid are particularly suitable.

Suitable comonomers having glass transition temperatures below 20° C., i.e., galss transition temperatures below room temperature (based in each case on homopolymers of a monomer) are esters of acrylic acid with $C_1$–$C_8$ alcohols and esters of methacrylic acid with $C_4$–$C_8$ alcohols. Thus, it is possible to use the methyl, ethyl, propyl, butyl or 2-ethylhexyl ester of acrylic acid and also the butyl, hexyl or 2-ethylhexyl ester of methacrylic acid. Comonomers wherein the homopolymers have glass transition temperatures above room temperature include esters of methacrylic acid with $C_1$–$C_3$ alcohols, such as for example, methyl methacrylate or ethyl methacrylate. A particularly important comonomer wherein the homopolymer has a glass transition temperature above room temperature, is styrene.

Copolymers of acrylic acid and/or methacrylic acid with styrene, acrylates and/or methacrylates are preferably used. Copolymers of acrylic acid or methacrylic acid with different acrylates and/or methacrylates and/or styrene, for example copolymers of methyl acrylate, ethyl acrylate, methacrylic acid and styrene, are particularly preferred.

The particular ratios of comonomers wherein homopolymers have glass transition temperatures below room temperature, and monomers wherein the homopolymers have glass transition temperatures above room temperature, have to be adjusted so that the film-forming temperature of the polymer dispersion is in the range of from 0° to 70° C. The film-forming temperatures mentioned apply to the plasticizer-free system, i.e. to the polymers without any other additions.

The polymers are preferably soluble in water only in the alkaline range, remaining undissolved in the acidic range. Corresponding products are often commercially available in emulsified form.

From 0.1 to 4.5% by weight of the polymers, expressed as pure polymer, are generally used in the preparations according to this invention. Preferred contents are from 0.2 to 2.9% by weight, and more especially from 0.2 to 1.0% by weight.

ALKALINE-REACTING COMPLEXING AGENTS

Water-soluble, preferably low molecular weight complexing agents (builders), which are capable of preventing problems attributable to water hardness in the application of the preparations, are suitable for the preparations according to the invention. Particularly suitable complexing agents are pentasodium triphosphate, trisodium citrate, sodium gluconate, tetrasodium ethylenediamine tetraacetate (EDTA-Na) and trisodium nitrilotriacetate (NTA-Na). EDTA-Na and/or sodium gluconate are preferably used. The quantities used are from 0.01 to 5% by weight, preferably from 0.05 to 3% by weight, and more preferably no more than 1% by weight, based on the preparation as a whole.

ALKALIZING AGENTS

The alkalizing agents are used together with the complexing agents to give the preparations a pH-value of from 8 to 10.5 and preferably of from 8.5 to 9.5 in their undiluted state. At these pH-values, the polymers are present at least partly in salt form. The choice of these agents is not critical providing they are compatible with the other constituents. Suitable alkalizing agents are, for example, ammonia, alkanolamines, alkaline-reacting salts, such as $Na_2CO_3$ or NaOH. Ammonia is preferably used. The alkalizing agents are used in quantities of up to 3% by weight and preferably in quantities of from 0.05 to 2% by weight, based on the preparation as a whole.

WATER-MISCIBLE ORGANIC SOLVENTS

Water-miscible organic solvents may be present in the cleaning preparation to boost their cleaning power, solvents having a good dissolving action on fats being preferred. Examples of solvents such as these are lower mono- and dialcohols, ether alcohols, polyethers and amines. Typical representatives of these solvent groups are, for example, isopropanol, butyl glycol, dimethyl diglycol and methyl pyrrolidone. Lower ether alcohols, for example mono- or diethylene glycol monoalkylethers containing from 1 to 4 carbon atoms in the alkyl group, are preferably used. The solvent content should be no more than 40% by weight, preferably no more than 20% by weight, and more preferably from 0.5 to 10% by weight, based on the weight of the preparation.

ADDITIVES

It is possible by incorporation of these standard ingredients to obtain additional effects as required in particular in the cleaning of floors, for example a pleasant odor or a disinfecting effect. In addition, ingredients such as these may be used to stabilize the preparations themselves and to make them attractive.

Examples of suitable additives are inorganic neutral salts, dyes, perfumes, foam inhibitors and antimicrobial agents. It is obvious that, when it comes to choosing, only those representatives of these substances should be selected which are compatible with other constituents of the preparations and which do not impair their action. The quantities of such additives amount in all to no more than 5% by weight, preferably to no more than 2% by weight, and more preferably to between 0.05 and 0.5% by weight, based on the weight of the preparation.

EXAMPLES

Tables 1 and 2 below show the composition of five preparations according to this invention and three state-of-the-art conventional preparations. The contents of the individual constituents are given in percent by weight, based on the final preparation and anhydrous constituents. All anionic sufactants used were as sodium salts.

The following alkali-soluble copolymers were used:

Polymer 1:

Primal(R) 644, a polymer dispersion from Rohm & Haas, Philadelphia, PA, USA.

Polymer 2:

Neocryl(R) BT 20, a polymer dispersion of Polyvinylchemie, Waalwijk, NL.

Polymer 3:

A copolymer of
58% by weight methyl methacrylate
30% by weight ethyl acrylate
10% by weight acrylic acid
2% by weight styrene.

TABLE 1

Composition of the preparations according to the invention

| Constituents | Examples 1 | 2 | 3 | 4 | 5 |
|---|---|---|---|---|---|
| $C_{11}$–$C_{14}$ alkylbenzene sulfonate | 2.5 | 4.0 | | | 2.5 |
| $C_{12}$–$C_{18}$ alkane sulfonate | | | 2.5 | | |
| $C_{12}$–$C_{18}$ alkyl sulfate | | | | 2.0 | |
| $C_{10}$–$C_{20}$ alkane diol + 12 EO | | | | | 2.5 |
| $C_{12}$–$C_{18}$ fatty alcohol + 10 EO | | | 3.0 | 1.0 | |
| Nonylphenol + 10 EO | 1.0 | 2.0 | | | 1.0 |
| Polymer 1 | | 1.5 | 3.0 | | |
| Polymer 2 | | | | 2.0 | 3.0 |
| Polymer 3 | 0.5 | | | | |
| EDTA-Na | 0.1 | 0.2 | 0.2 | 0.8 | 0.2 |
| Ammonia | | 0.5 | | | 0.3 |
| Isopropanol | | | | 10.0 | 5.0 |
| Ethyleneglycol monobutylether | | | | | 5.0 |
| Sodium hydrogen phosphate | | 1.0 | 3.0 | | 2.5 |
| Preservative | 0.15 | 0.2 | 0.2 | | 0.2 |
| Perfume Oil | 0.2 | 0.3 | 0.2 | | 0.4 |
| Dyes | 0.0002 | 0.01 | | | 0.015 |
| Water | ad 100 | ad 100 | ad 100 | ad 100 | ad 100 |

TABLE 2

Composition of state-of-the-art preparations

| Constituents | Examples 6 | 7 | 8 |
|---|---|---|---|
| $C_{12}$–$C_{18}$ alkane sulfonate | | 1.5 | |
| $C_{12}$–$C_{14}$ alkyl sulfate | 1.0 | | |
| $C_9$ alkylphenol + 2 EO-sulfate | 2.0 | | |
| $C_8$–$C_{18}$ alkalimetal-ammonium soap | | 1.8 | |
| Nonylphenol + 10 EO | | | 0.8 |
| $C_{12}$–$C_{18}$ fatty alcohol + 10 EO | 5.0 | 1.5 | |
| Montan wax | | 4.0 | |
| Pre-oxidized polyethylene wax | | 1.0 | 1.5 |
| Polyethylene wax | | 1.0 | |
| Maleic acid resin | | | 0.8 |
| Copolymer of methacrylic acid and methacrylate (metal-crosslinked) | | 4.0 | |
| Copolymer of styrene and acrylic acid (metal-crosslinked) | | | 12.0 |
| EDTA-Na | 0.2 | | |
| Dietheylene glycol monobutyl ether | | 1.5 | 6.5 |
| Tributoxyethyl phosphate | | 0.5 | 3.0 |
| Sodium phosphate | 4.0 | | |
| Preservative | 0.2 | 0.3 | 0.3 |
| Perfume oil | 0.2 | 0.2 | 0.3 |
| Dyes | 0.01 | | |
| Water | ad 100 | ad 100 | ad 100 |

TESTING OF THE CLEANING ACTION

The cleaning action of the wiping preparations was tested using a Gardner washability and abrasion tester as described in the quality standards of the Industrieverband Putz- and Pflegemittel e.V. (Seifen-Ole-Fette-Wachse, 108, pages 526–528 (1982)). In this method, a white PVC-film is provided with a test soil of carbon black and fat and machine-wiped under standardized conditions with a sponge impregnated with the cleaning preparation. The cleaning performance is measured by photoelectric determination of the degree of remission.

TESTING OF THE PRESERVING ACTION

The preserving action is reflected, inter alia, in the fact that a film originating from earlier treatments with the same preparation facilitates the removal of soils subsequently applied.

Accordingly, the test described above was modified to the extent that, before application of the same soil, the film was wiped with the wiping preparation to be tested and then dried. After application of the soil, testing was carried out in the same way as for the cleaning action.

Table 3 shows the test results for all eight preparations. The results are expressed in percent light remission, based on white=100%. In every test, the preparations were used in diluted form at a concentration of 2% by weight.

It is clear from the results that wiping preparations 1 to 5 according to the invention have an excellent cleaning action both with respect to nonpretreated film and with respect to pretreated film. The soil is removed even better from pretreated film than from the original film. By contrast, comparison preparations 6 to 8 produce good cleaning results either only on non-pretreated film (6) or only on pretreated film (7,8). Preparation 8 is entirely comparable in its preserving action with the preparations according to the invention but, unlike those preparations, leads after repeated application to an accumulation of films which mars the natural appearance of the treated surfaces.

TABLE 3

| | Cleaning and preserving action | |
|---|---|---|
| Preparation | Cleaning (whiteness after cleaning of the un-pretreated film) | Preserving (whiteness after cleaning of the pretreated film) |
| 1 | 85 | 89 |
| 2 | 72 | 87 |
| 3 | 81 | 88 |
| 4 | 74 | 80 |
| 5 | 79 | 83 |
| 6 | 79 | 51 |
| 7 | 51 | 68 |
| 8 | 47 | 83 |

I claim:

1. A process for cleaning and preserving a floor surface consisting essentially of (1) wiping said floor surface with a 1 to 3% aqueous solution of a composition consisting essentially of:

(a) from 0.5 to 10% by weight of a surfactant selected from the group consisting of adducts of ethylene oxide with alchols or alkylphenols, alkyl benzene sulfonates, alkyl sulfates, alkane sulfonates, fatty acid ester sulfonates and mixtures thereof;

(b) from 0.1 to 4.5% by weight of an alkali-soluble, non-metal-crosslinked polymer compound having a minimum film-forming temperature of from 0° to 70° C.;

(c) from 0.01 to 5% by weight of an alkaline-reacting complexing agent;

(d) from 0 to 3% by weight of an alkalizing agent;

(e) from 0 to 40% by weight of a water-miscible organic solvent;

(f) from 0 to 5% by weight of additives; and (g) the remainder, water; and (2) allowing said aqueous solution to dry on said floor surface.

2. A process in accordance with claim 1 wherein said composition consists essentially of:

(a) from 1 to 6% by weight of a surfactant selected from the group consisting of adducts of ethylene oxide with alcohols or alkylphenols, alkylbenzene sulfonates, alkyl sulfates, alkane sulfonates, fatty acid ester sulfonates and mixtures thereof;

(b) from 0.2 to 2.0% by weight of an alkali-soluble, non-metal-crosslinked polymer compound having a minimum film-forming temperature of from 0° to 70° C.;

(c) from 0.05 to 3% by weight of an alkaline-reacting complexing agent;

(d) from 0.05 to 2% by weight of an alkalizing agent;

(e) from 0 to 20% by weight of a water-miscible organic solvent;

(f) from 0.05 to 2% by weight of additives; and (g) the remainder, water.

3. A process in accordance with claim 1 wherein said surfactant is selected from the group of adducts of 8–20 moles ethylene oxide with $C_{12}$-$C_{18}$ fatty alcohols, $C_{12}$–$C_{18}$ alkane sulfonates, alkyl benzene sulfonates containing from 9 to 15 carbon-atoms in the alkyl group, and mixtures thereof.

4. A process in accordance with claim 1 wherein said composition contains both anionic and nonionic surfactants.

5. A process in accordance with claim 1 wherein said alkali-soluble polymer compound is selected from the group consisting of copolymers of acrylic acid and/or methacrylic acid with styrene, acrylates and/or methacrylates.

6. A process in accordance with claim 1 wherein said alkali-soluble polymer compound is a copolymer of acrylic acid or methacrylic acid with acrylates and/or methacrylates and styrene.

7. A process in accordance with claim 1 wherein said water-miscible organic solvent is selected from the group consisting of mono- or diethylene glycol monoalkyl ethers containing from 1 to 4 carbon-atoms in the alkyl group.

8. A process in accordance with claim 1 wherein said composition consists essentially of:

(a) from 1 to 6% by weight of a surfactant mixture of at least one adduct of 8–20 moles ethylene oxide with $C_{12}$–$C_{18}$ fatty alcohols and/or alkylbenzene sulfonate and/or alkane sulfonate;

(b) from 0.2 to 1% by weight of a copolymer of methyl acrylate, ethyl acrylate, methacrylic acid and styrene;

(c) from 0.05 to 1% by weight of ethylene diamine tetraacetate;

(d) from 0.5 to 10% by weight of a water-miscible organic solvent selected from the group consisting of mono- or diethylene glycol monoalkyl ethers containing from 1 to 4 carbon-atoms in the alkyl group;

(e) from 0.1 to 0.5% by weight of additives; and (f) the remainder, water.

9. A process in accordance with claim 1 wherein said composition has a pH-value of from 8 to 10.5.

10. A process in accordance with claim 1 wherein said additives include inorganic neutral salts, dyes, foam inhibitors, and antimicrobial agents.

* * * * *